US006176160B1

(12) United States Patent
Ruhlander et al.

(10) Patent No.: US 6,176,160 B1
(45) Date of Patent: Jan. 23, 2001

(54) BIT FOR DRIVING A THREADED FLANGE COVER FOR A GAS VALVE

(76) Inventors: Gordon P. Ruhlander, 2103 High Ridge, Pleasant Hill, MO (US) 64080; Joe R. Brooks, 6824 James A. Reed Rd., Kansas City, MO (US) 64133

( * ) Notice: Under 35 U.S.C. 154(b), the term of this patent shall be extended for 0 days.

(21) Appl. No.: 08/896,721

(22) Filed: Jul. 18, 1997

(51) Int. Cl.[7] ..... B25B 23/00
(52) U.S. Cl. ..... 81/438; 81/180.1; 81/177.85
(58) Field of Search ..... 81/438, 180.1, 81/184, 177.1, 177.2, 177.85, DIG. 11, 121.1, 436

(56) References Cited

U.S. PATENT DOCUMENTS 3,875,829 * 4/1975 Evans et al. ..... 81/177.2 X
4,436,005 * 3/1984 Hanson ..... 81/177.85 X
4,503,737 * 3/1985 DiGiovanni ..... 81/441 X
5,216,940 * 6/1993 Hedden ..... 81/177.85 X
5,361,656 * 11/1994 Starr ..... 81/177.85 X
5,568,757 * 10/1996 Lewis ..... 81/177.85 X
5,813,296 * 9/1998 Hoff et al. ..... 81/177.85

* cited by examiner

*Primary Examiner*—D. S. Meislin
(74) *Attorney, Agent, or Firm*—Peter M. Peer; Philip A. Mallinckrodt

(57) ABSTRACT

Components of a an assembly of operatively related devices for installing a flange cover for a gas valve include a bit especially useful for engaging a corresponding access hole or opening in the face plate portion of a flange cover for transmitting torque thereto for coupling it with a matingly threaded gas valve. The bit end of the bit may have a hole extending axially therethrough and is preferably successively smaller as the end is approached. In one embodiment the bit includes a drive end of a shape differing from the bit end so that a shoulder is formed separating the two ends and providing a stop to prevent the bit from sliding into the hole in which it is engaged. In another embodiment, the drive end is circular with a square recess to accept a drive lug of an appropriate driving tool.

3 Claims, 5 Drawing Sheets

BIT FOR DRIVING A THREADED FLANGE COVER FOR A GAS VALVE

BACKGROUND OF THE INVENTION

1. Field

This invention relates to a an assembly of operatively related devices, which, according to this invention, includes a bit tool for use with a wrench or driver device for applying torque to a decorative flange cover for a gas shut off valve such as that used in connection with gas fireplaces and traditional wood fireplaces having a gas starter jet.

2. State of the Art

Flange covers for gas shut off valves such as used in connection with gas fireplaces and traditional wood burning stoves and fireplaces having gas starter jets are in common use. The gas valve in such installations are usually located behind a wall or underneath a floor with access to the valve stem provided through a rough opening in the floor or wall. The rough opening is covered over by a decorative flange cover which usually has a decorative face with an access opening providing access to the valve stem and an internally threaded cylindrical portion for mating engagement with an externally threaded collar on the gas valve. Thus, when the flange cover is coupled to the gas valve, the rough opening is sealed and access is provided to the valve stem in the chamber formed between the gas valve housing and the flange cover. This chamber may collect dust, dirt, and fireplace debris which may be difficult to clean. It would be advantageous to provide a tool for uncoupling the flange cover for cleaning or other purposes and for initial installation as well. Heretofore coupling and uncoupling of the gas flange cover has been accomplished by hand.

SUMMARY OF THE INVENTION

It is an object of the invention to provide for installing a gas control valve and its accessory components, which may include a gas valve, a flange cover, and to provide an inexpensive bit tool for applying torque to the flange cover for original installation or for removing the flange cover for cleaning or other purposes, and a driving tool for transmitting torque to the aforementioned tool. The bit tool provided in such an assembly has a bit portion which interlockingly engages with the usual access opening in the usual flange cover and thereby provides for easy installation or removal of the flange cover and also allows application of torque to it without causing damage to the face of the flange cover.

A key feature of the invention is the tool for transmitting torque to a threaded device, normally a flange cover, to couple the threaded flange cover to the receiving threads of a specially threaded gas valve, which comprises a novel bit. All flange covers are provided with an access opening, but with the instant invention the shape of the bit and the shape of the hole in the flange cover are interlocking to permit the transmission of torque. In a preferred embodiment the bit has a hole extending axially therethrough and the bit is progressively smaller toward the end. This tapering allows for easy entry of the undersize portion of the bit into the flange cover opening, the accommodation of flange covers having different sized openings for receipt of the bit, and the oversize portion of the bit acts as a stop to prevent the bit from continuing to slide into the hole in the flange. The hole referred to above is of sufficient size to allow free movement around the normally square shaped valve stem. The bit may be attached to shaft and handle or may be incorporated into an elongated tool having two functional ends, i.e., a bit end and a drive end of the same or different shape than the bit end. In the most preferred embodiment, the drive end has a square shaped recess for receipt of an appropriate corresponding shaped driving tool, such as a square ended lug of a rachet wrench. In another embodiment a round shoulder is provided which separates the bit end and drive end and prevents the bit end from sliding into the flange cover opening. The bit may be injection molded of a soft plastic material to prevent marring of the decorative flange cover surface.

The invention also encompasses a novel method for coupling and uncoupling a flange cover to a gas valve by use of a bit which has a shape for mating interlocking engagement with the access hole of a flange cover.

BRIEF DESCRIPTION OF DRAWINGS

The foregoing and further and more specific objects and advantages of the instant invention will become readily apparent to those skilled in the art from the following detailed description of embodiments thereof taken in conjunction with the drawings, in which.

DETAILED DESCRIPTION OF THE PREFERRED EMBODIMENT

Figure 1:
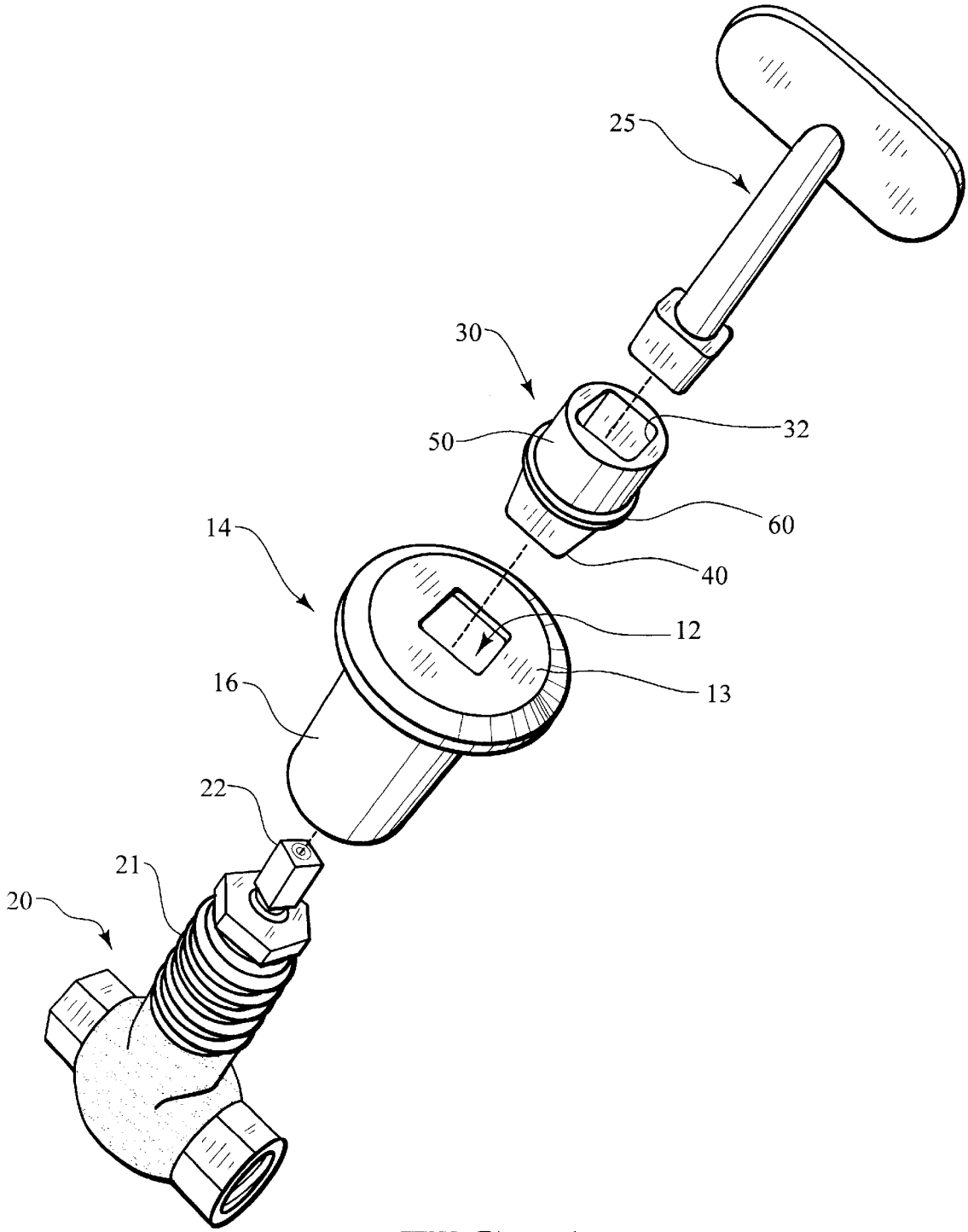
FIG. 1 is an exploded view illustrating a preferred embodiment of the bit of the present invention and its use in conjunction with a gas valve, flange cover, and a gas valve key.

Turning now to the drawings in which like reference numbers indicate corresponding elements throughout the several views, attention is first directed to FIG. 1 which illustrates a gas valve 20, flange cover 14, a bit 30 fashioned in accordance with the invention, and a valve key 25. Gas valves used in gas fireplaces and heating stoves and wood burning fire places supplied with gas starter jets usually have a square shaped valve stem 22, which is operated by a key 25 having a square end 26 and a square shaped recess (not shown) for engagement therewith. All or some of the components illustrated may be supplied as components of an installation kit for assembly at new or remodel construction sites involving natural gas or propane and the like.

Figure 2:
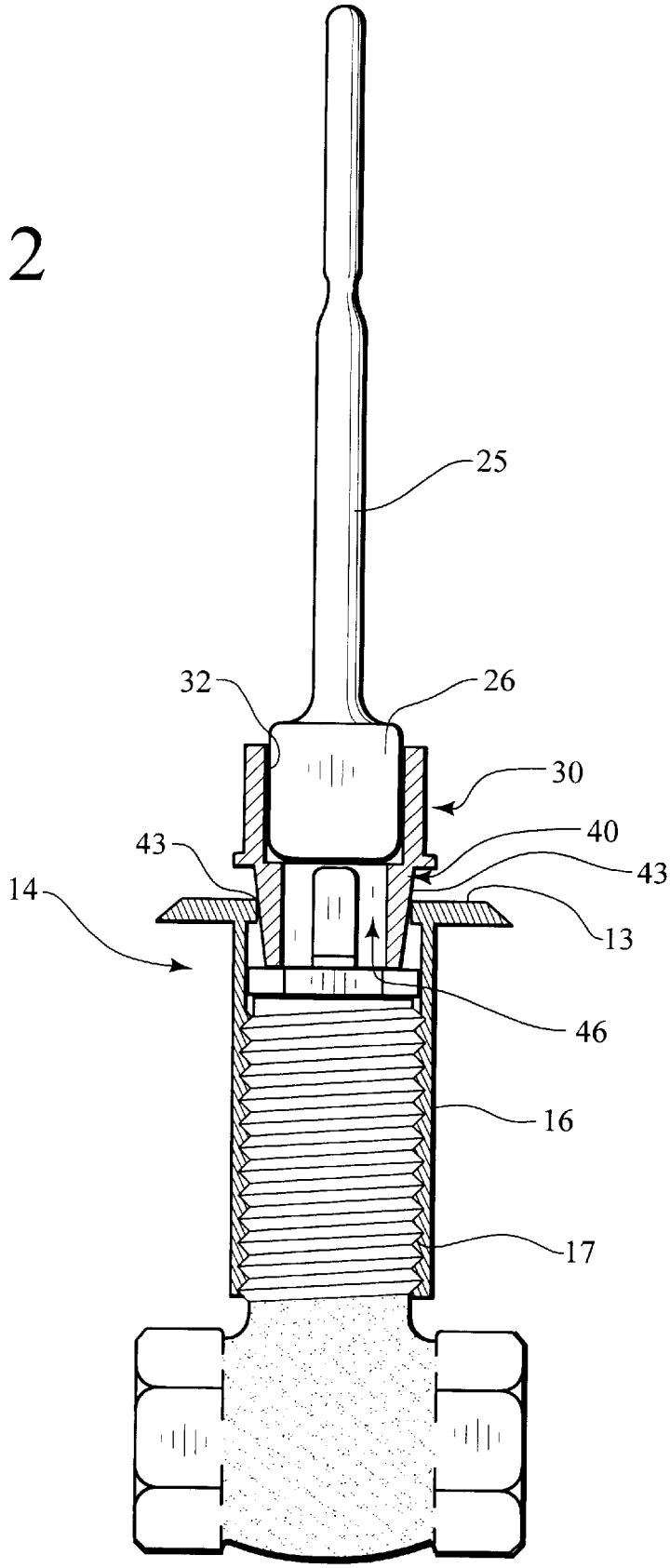
FIG. 2 is a side view of the components of FIG. 1 shown assembled and with the flange cover and bit of the invention shown in section.

In actual practice, gas valve 20 is installed behind a wall surface or under the floor surface with the externally threaded portion 21 of gas valve 20 oriented perpendicular to the surface with a rough opening made in the surface allowing access to externally threaded portion 21. As shown in FIG. 2, cylindrical portion 16 of flange cover 14 is internally threaded 17 for mating engagement with the external threads of gas valve 20.

Bit 30, FIGS. 1–7, has a first end, tapered bit end 40, which is fashioned for interlocking insertion into corresponding opening 12 (arrow, FIG. 1) in the face 13, FIGS. and 2, of flange cover 14. Although the interlocking shapes in this instance are square, any mating interlocking shapes could be employed so long as access through the opening is sufficient to allow passage of an actuating key, such as key 25, FIGS. 1 and 2. Accordingly, at least some portion of tapered bit end 40 is small enough to enter and interlock with opening 12, but greater in size than key 25 which passes entirely through opening 12 when used to operate the valve.

Figure 3:
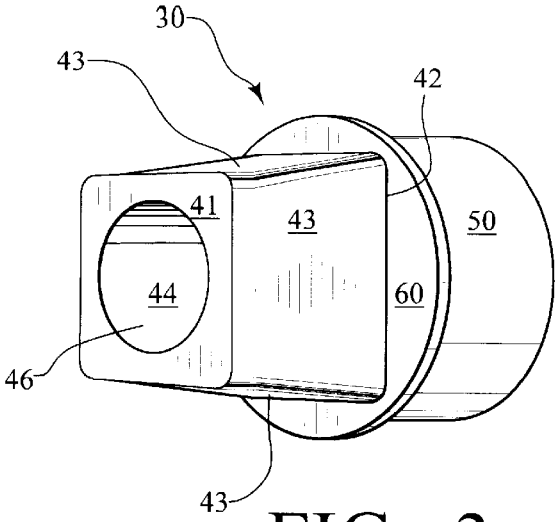
FIG. 3 is another perspective view of the bit shown in FIG. 1.
Figure 4:
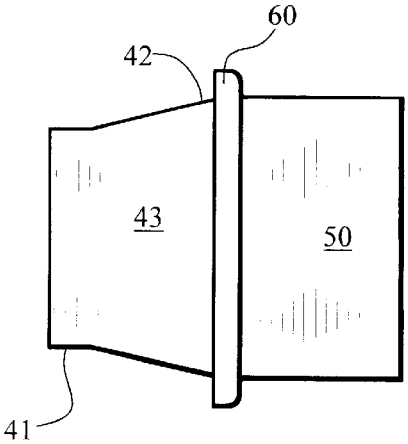
FIG. 4 is a side view of the embodiment of FIG. 3.
Figure 6:
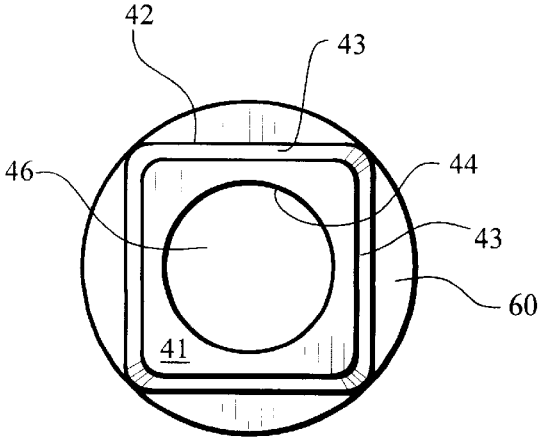
FIG. 6 is a bottom view (referred to herein as the first end or bit end) of the same embodiment of FIG. 3.
Figure 7:
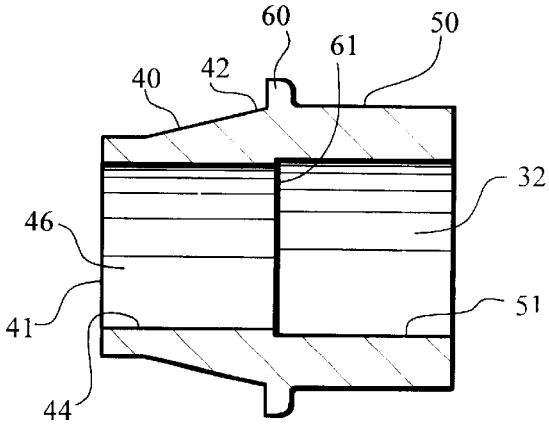
FIG. 7 is a sectional side view of the embodiment of FIG. 3.

Bit end 40 of bit 30 is elongate and has an apical end portion 41 and a base portion 42 (FIGS. 3, 4, and 7). Bit 30 may be supplied with a shoulder 60, FIGS. 3–7, which in this embodiment demarcates the base of bit end 40 from drive end 50 and supplies a stop to prevent further sliding of the bit into opening 12 of face 13 of flange cover 14. Preferably bit 30 is injection molded of a soft plastic material so that shoulder 60 is prevented from marring the usually decorative surface of face 13.

In the embodiment depicted in FIGS. 1–7, the second end, or drive end 50, of bit 30 is provided to engage a driving tool. Although this objective could be accomplished in a wide variety of means such as a slot or slots for receipt of a standard or a Phillips screw driver, an external polygonal shape for engagement with a wrench or socket, or a polygonal shaped recess other than the square shape depicted, it is in this instance a hole running axially through drive end 50 of substantially square transverse cross section, drive recess 32, FIGS. 1, 2, 5 and 6, for receiving a corresponding square drive lug of an associated driving tool, such as key 25, or a conventional ratchet wrench (not shown). Although not provided in the embodiment illustrated in FIG. 1, drive recess 32 may optionally be provided with detent In the embodiment depicted in FIGS. 1–7, the second end, or drive end 50, of bit 30 is provided to engage a driving tool. Although this objective could be accomplished in a wide variety of means such as a slot or slots for receipt of a standard or a Phillips screw driver, an external polygonal shape for engagement with a wrench or socket, or a polygonal shaped recess other than the square shape depicted, it is in this instance a hole running axially through drive end 50 of substantially square transverse cross section, drive recess 32, FIGS. 1, 2, 5 and 6, for receiving a corresponding square drive lug of an associated driving tool, such as key 25, or a conventional ratchet wrench (not shown). Although not provided in the embodiment illustrated in FIG. 1, drive recess 32 may optionally be provided with detent recesses for receiving a detent ball of the associated drive lug of the driving tool to retain bit 30 in place on the driving tool in a known manner. It is most preferred for the recess to be adapted to receive the lug from a ½ inch square drive lug.

Referring to FIG. 2, the components shown in FIG. 1 are depicted as they would occur when assembled with a partial sectional view of bit 30 and flange cover 14 to better show the advantages of the invention. Square end 26 of key 25 is shown engaged with drive recess 32. A user may thus apply torque to the handle of the key and turn the flange cover. Optional shoulder 60 of bit 30 is shown, but not in use as the tapered side walls stop the bit from sliding entirely through access opening 12 in flange cover 14. Referring generally to FIGS. 1–7, bit end 40 may have hole 46 (arrow FIGS. 3, 6, and 7) running axially therethrough defined by cylindrical wall 44 which provides sufficient clearance to allow bit 30 and flange cover 14 with which it is engaged to turn freely around valve stem 22 without actuating the valve. Internal threads 17 of cylindrical portion 16 of flange cover 14 are illustrated in FIG. 2 fully matingly engaged with externally threaded portion 21 of the gas valve housing. Consequently, the chamber housing the valve stem within the flange cover, i.e., the free space within the flange cover accessible through opening 12, FIG. 1, is relatively shallow and the desirability of free clearance around the valve stem provided within the bit end is demonstrated, as seen in FIG. 2, when the flange cover and gas valve are coupled.

Figure 5:
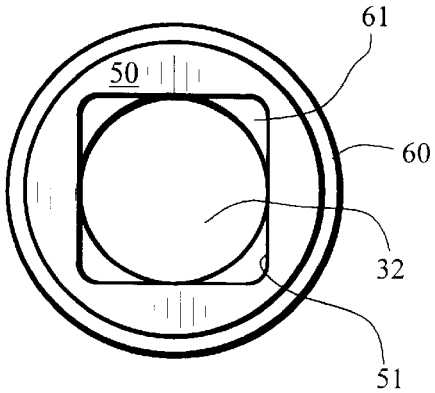
FIG. 5 is a top view (referred to herein as the second end or driver end) of the embodiment of FIG. 3.

Referring particularly to FIG. 5, an end view of drive end 50 is illustrated (arbitrarily designated a top view in the brief description of the drawings). As seen in FIG. 5, drive end 50 includes a cylindrical body having centrally located square shaped recess 32.

Bit end 40 is adapted for interlocking engagement with the access opening in the face of the usual flange covers as illustrated by access opening 13 in flange cover 14 in FIGS. 1 and 2. Such access openings are square on all current commercially popular models, and although all commercial models are not of uniform dimensions, the range of dimensions encountered can be accommodated in a single bit end such as that depicted where the transverse cross sectional area of base of the bit end is greater than that of free or apical end. This forms a tapered bit that will accommodate a range of different sized openings. The tapering is perhaps best illustrated in side view in FIG. 4, where 42 indicates the broader base of the bit and 41 indicates the narrower apical end (arbitrarily considered the bottom of the bit and hence FIG. 6, a bottom view). This tapering is optional, of course, as bits of different sizes for different sized access openings may be provided preferably with an outwardly extending shoulder at the base of the bit end similar to shoulder 60 of bit 30.

As seen in end view, i.e., bottom view, in FIG. 6, bit end 40 has hole 46 running therethrough of circular transverse cross section, although the shape of the hole is optional. Cylindrical wall 44 forms the boundary of hole 46. Walls 43, seen also in FIGS. 3 and 4, of bit end 40 can be seen in bottom view due to the tapering effect, but accentuated shoulder 60 obscures drive end 50 in this view. As mentioned, provision of this hole is preferred as it allows bit 30 when engaged with flange cover to turn freely without engaging the square valve stem or opening the valve and also allows for better results with injection molding.

As seen in cross section in FIG. 7, around the mid-portion in the axially running hole from end to end in bit 30, a transition takes place from a transverse cross sectional shape of a square to a cross sectional transverse shape of a circle in this embodiment forming an internal shoulder 61. When transitioning from two differing shapes or two similar shapes of differing sizes such a shoulder may be formed, especially in an injection molding process. This is the case for outwardly directed shoulder 60, FIGS. 3–7, and is also the case for internally directed shoulder 61 seen in sectional side view in FIG. 7 and in top view in FIG. 5. Drive end 50, or as also referred to herein as the second end of the bit, as illustrated in end view, FIG. 5 (also seen in FIG. 7), has internally directed shoulder 61 which forms a shelf with the unusual shape of a circle cut out of the bottom of the recess in second end 50. Shoulder 61, although not essential, may provide a useful stop for some types of drivers upon insertion into the drive recess in drive end 50. It has been found particularly advantageous to accentuate external shoulder 60, FIGS. 1–7. Outwardly projecting shoulder 60 also acts as a stop to prevent the bit end from sliding into larger access openings (not shown) provided in some commercially available flange covers. As shown in FIGS. 4–6 the round hole running through bit end 40 may communicate with the square recess in the socket drive end 50 and results in the unusual shaped shelf mentioned. Although this communication is optional, it may facilitate manufacture by means such as injection molded plastic by preventing the tendency of some polymers to shrink after the molding process.

FIGS. 8–12 depict a different embodiment of the elongate bit of the invention where second end, drive end 72, of bit 80 is square rather than cylindrical as in the embodiment depicted in FIGS. 1–7 and there is no external shoulder demarcating the boundary of the first and second ends. Except in these particular aspects this embodiment is quite analogous to the previous embodiment.

In this particular embodiment, bit 80 is a unitary structure. As seen in end view in FIG. 9, drive end 72 is square and has a square recess 71, i.e., a hole running axially therethrough of square transverse cross section adapted for use with an associated drive tool. This embodiment, accordingly, similar to the embodiment of FIGS. 1–7, is adapted for receipt of a square drive lug of an associated driving tool. As an alternative to fashioning the bit for receipt of a drive tool in a drive recess, the outside shape of the drive end may be adapted to interlock with a drive tool as is the case in this embodiment. Preferably the shape is polygonal and most preferably square and adapted in size to interlock with a standard size open end wrench or twelve point box or socket wrench as it depicted in FIGS. 8–12. Bit 80 has a mid portion from which point the cross sectional area of the square bit end 90 tapers so that it can readily be realized that the cross sectional area of base portion 92 is greater than apical end 91, thus giving a tapered shape to the first end. Drive end 72 is preferably of sufficient size to act as a stop to prevent the bit from sliding too far into the access hole in the face of a flange cover with which it is engaged.

Bit end 90 is adapted for mating engagement with the access opening in the face of the usual flange covers. To accommodate the range of dimensions of openings encountered currently commercially popular models of flange covers, the transverse cross sectorial area of the base of the bit end is greater than that of apical end. In other words, the bit becomes successively smaller toward the end or is tapered. That is perhaps best illustrated in FIGS. 10 and 11, where 92 indicates the broader base of the bit end and 91 indicates the narrower apical end, arbitrarily considered the bottom of the bit.

Figure 8:
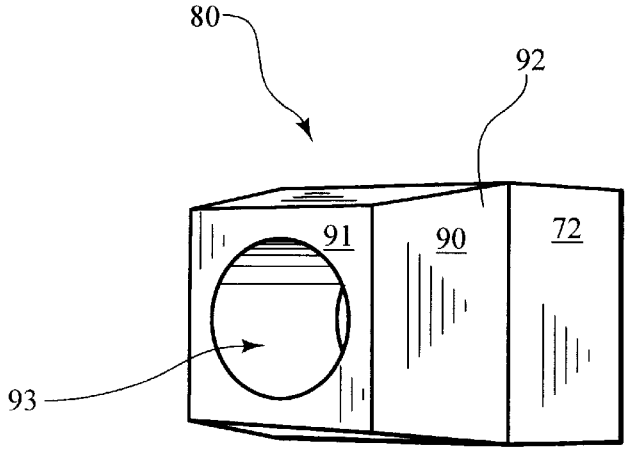
FIG. 8 is a perspective view of an alternative embodiment.
Figure 10:
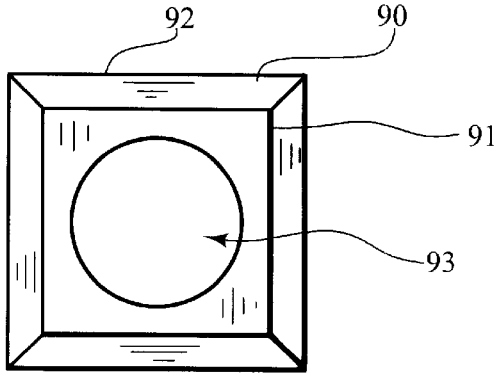
FIG. 10 is a bottom view (referred to herein as the first end or bit end) of the embodiment of FIG. 8.
Figure 11:
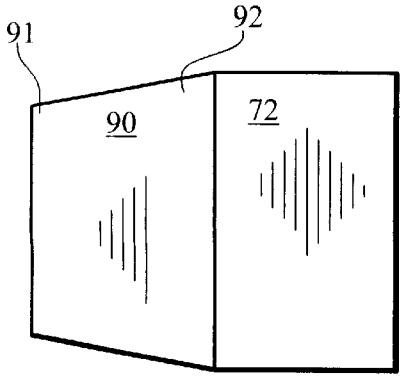
FIG. 11 is a side view of the embodiment of FIG. 8.

As seen in bottom view, FIG. 10, bit end 90 has hole 93 (arrow), also seen in FIG. 8, running therethrough of circular transverse cross section, although the shape of the hole is optional. The exterior walls of bit end 90 can be seen in bottom view due to the tapering effect. Provision of the hole is preferred as it allows bit 80 when engaged with a flange cover to turn freely without engaging the square valve stem or opening the valve.

Figure 9:
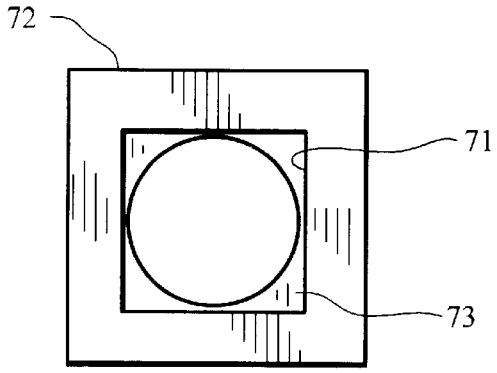
FIG. 9 is a top view (referred to herein as the second end or driver end) of the embodiment of FIG. 8.
Figure 12:
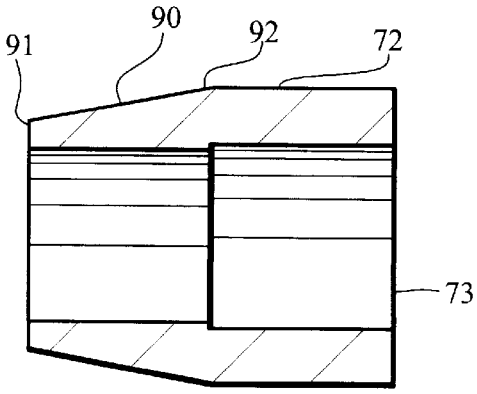
FIG. 12 is a sectional view of the embodiment of FIG. 8.

The transition from the round hole in bit end 90 to the square recess in driver end 70 can be seen to form an internal shoulder 73, seen in FIGS. 9 and 12, around the mid-portion in the hole running axially end to end in bit 80. This shoulder is optional and, as mentioned in reference to the embodiment of FIGS. 1–7, this communication is optional, but it may facilitate manufacture by means such as injection molding by preventing the tendency of some polymers to shrink after the molding process. Internal shoulder 73 is formed as a result of the choice of shapes and sizes of holes, but may be useful as a stop for an associated driver tool inserted into the drive recess.

Figure 13:
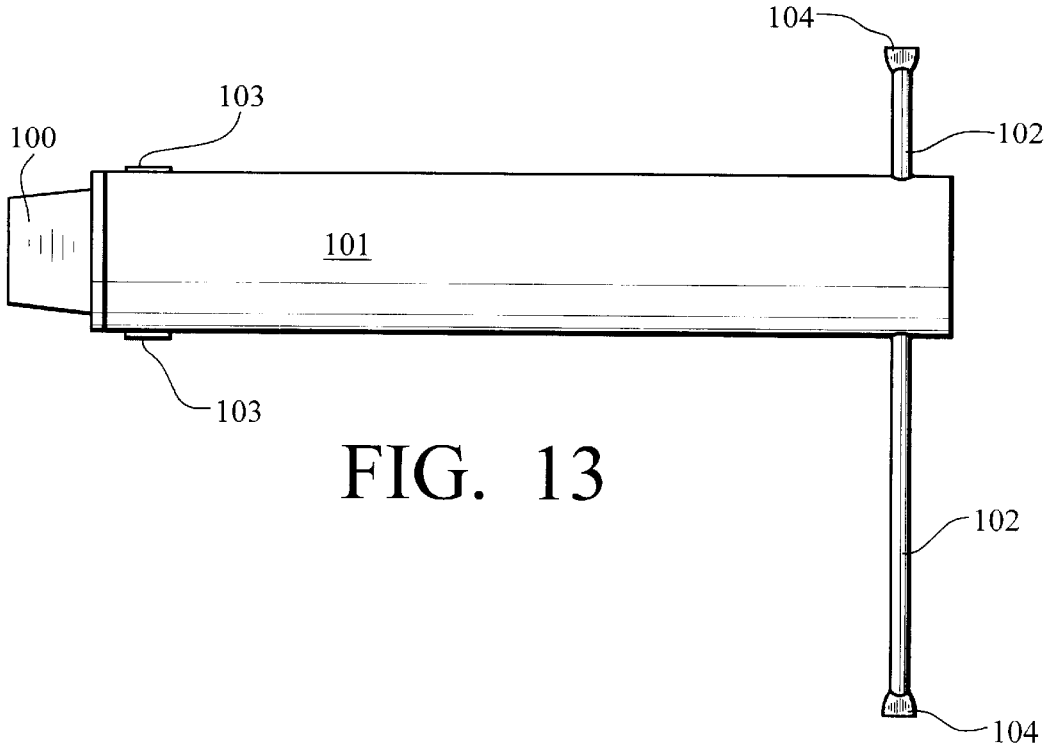
FIG. 13 is a side view of yet another alternative embodiment.
Figure 14:
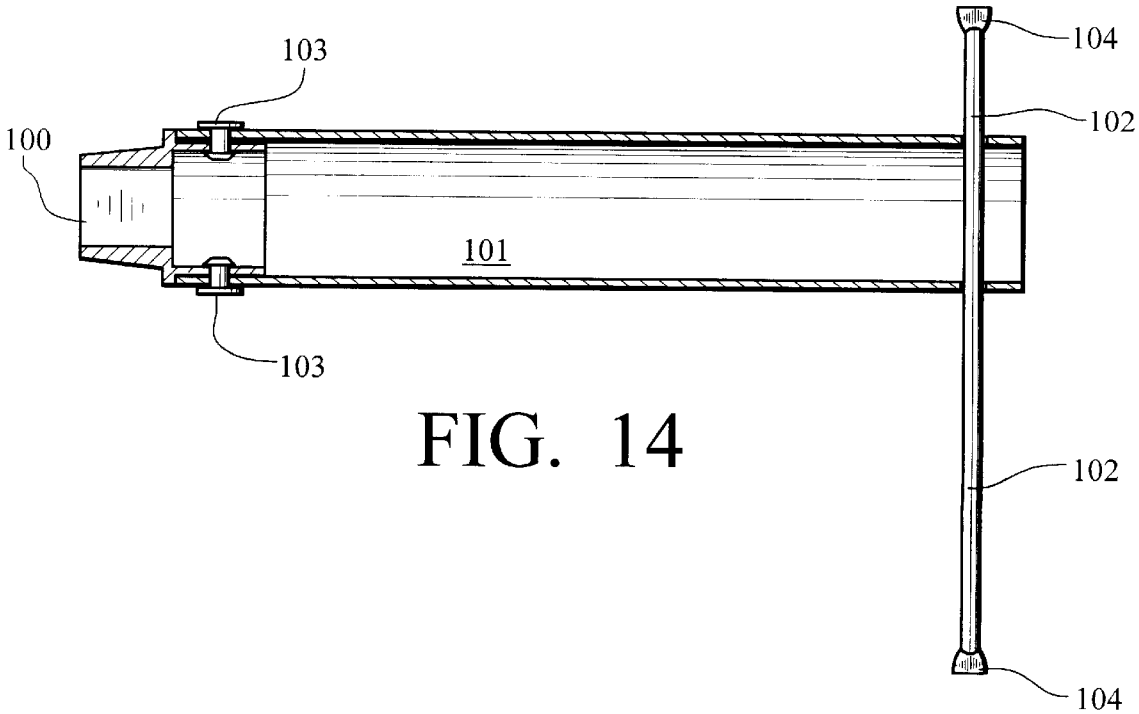
FIG. 14 is a sectional view of the embodiment of FIG. 13.

FIGS. 13 and 14 depict yet another alternative embodiment of the invention. Bit 100 is secured by rivets 103 to shaft 101 at one end. Shaft 101 has a handle 102 at the other end. Ends 104 of the handle are flared to secure it to shaft 101. Bit 100, as best seen in in sectional view in FIG. 14, is similar in every aspect to the bit embodiment of FIGS. 1–7 with the exception that the hole 105 running axially through the base of the bit has a round rather than a square transverse cross section as illustrated in section in FIG. 14.

The method according to the invention is for coupling or uncoupling a flange cover to a gas valve. First, a gas valve is provided having threads for mating engagement with a flange cover having corresponding threads. Second, a flange cover having an access opening with a shape permitting interlocking engagement with a bit is provided. Third, a bit having a shape permitting interlocking engagement with the access opening in the flange cover is provided. Fourth, torque is applied to the bit in the desired direction to achieve either coupling or uncoupling.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. An assembly of multiple, operationally related devices, which assembly comprises a gas control valve device having a valve stem rotatable in an externally threaded housing therefor, with an operating end portion of said stem projecting from said housing; an internally threaded, cylindrical, flange cover device having a face plate provided with an opening for access to said projecting end portion of said valve stem; and an elongate bit tool device having a longitudinal, bit end portion configured to interlockingly engage said access opening of said flange cover face plate and having an opposite end portion for engagement by a torque-imparting device to turn said flange cover for screwing it toward or away from said gas control valve, said bit end portion of the bit tool device having its bit end open and recessed inwardly therefrom to accommodate the said projecting end portion of said valve stem without engagement therewith.

2. An assembly of devices according to claim 1, wherein the longitudinal bit end portion thereof increases in size progressively transversely thereof as it extends towards the opposite end portion of the bit tool.

3. An assembly of devices according to claim 1, wherein the opposite end portion of the bit tool device is a longitudinal extension of the bit end portion thereof, which extension is recessed inwardly from an open free end thereof; and said assembly includes a torque imparting key device having a free end for fitting into the recess of said longitudinal extension of the bit end portion of the bit tool device.

* * * * *